US005331773A

United States Patent [19]

Biancalani et al.

[11] Patent Number: 5,331,773

[45] Date of Patent: Jul. 26, 1994

[54] MACHINE AND METHOD FOR THE ABRASIVE TREATMENT OF FABRICS

[75] Inventors: Fiorenzo Biancalani, Prato; Luigi Marcora, Vicchio, both of Italy

[73] Assignees: Officina Meccanica Biancalani & C. di Fiorenzo Biancalani; Coramtex S.r.l., both of Prato, Italy

[21] Appl. No.: 942,592

[22] Filed: Sep. 9, 1992

[30] Foreign Application Priority Data

Sep. 13, 1991 [IT] Italy ..... FI/91/A 224

[51] Int. Cl.[5] ..... B24B 1/00

[52] U.S. Cl. ..... 51/281 R; 51/328; 8/138; 8/147

[58] Field of Search ..... 51/281 R, 317, 318, 51/323, 328, 66, 74 R, 75, 78; 8/138, 139, 147

[56] References Cited

U.S. PATENT DOCUMENTS

| | | | |
|---|---|---|---|
| 2,402,689 | 6/1946 | Snow | 51/75 |
| 2,540,367 | 2/1951 | Hamulton | 51/75 |
| 2,551,377 | 5/1951 | Illmer | 51/75 |
| 3,973,359 | 8/1976 | Spencer | 51/75 |
| 4,295,845 | 10/1981 | Sepulveda | 8/139 |
| 4,608,037 | 8/1986 | Fleming | 51/74 R |
| 4,841,751 | 6/1989 | Ricci | 51/164.1 |
| 4,931,063 | 6/1990 | Wilsberg | 8/137 |
| 5,109,630 | 5/1992 | Love | 51/74 R |

*Primary Examiner*—M. Rachuba
*Attorney, Agent, or Firm*—McGlew and Tuttle

[57] ABSTRACT

The machine for the superficial abrasive treatment of fabrics comprises means (B1, B2, 1, 3, 5, 7, 9, 11) for feeding the fabric (T) for treatment and for pressing said fabric against an abrasive means (29; 51) which exerts an abrasive action on said fabric. The abrasive means comprises one or more blocks (33, 34, 35, 36; 51) of a natural, artificial or synthetic cellular or honeycombed abrasive material; the relative velocity between the active surface of the abrasive means and the fabric is between 10 and 60 m/min.

13 Claims, 4 Drawing Sheets

MACHINE AND METHOD FOR THE ABRASIVE TREATMENT OF FABRICS

FIELD OF THE INVENTION

The invention relates to a machine for the superficial abrasive treatment of fabrics, comprising means for feeding a fabric for treatment and for pressing the fabric against a means of abrasion which exerts an abrasive action against the fabric.

The invention relates also to a method for the treatment of fabrics by abrasion.

BACKGROUND OF THE INVENTION

In the textile industry it is often necessary to carry out a slight superficial abrasion of a fabric in order to obtain a superficial ageing effect, perform opacifying and ageing treatments or for similar purposes. Machines presently built for this comprise one or more motorized rollers rotating at high speed, typically 600–1500 revolutions/minute with a fabric forwarding speed of 4–15 m/minute. Around these rollers an abrasive paper is wound and run against the fabric to be treated.

Where an opacifying treatment is required, these machines present real drawbacks in that the abrasive employed consists of particles of silica or corundum supported by a paper or other suitable support. These particles have sharp angles which exert an abrasive action that cuts the fibers, with a consequent risk of damage to the fabric due particularly to the high relative speed between the active surface of the abrasive and the fabric. Furthermore, the abrasive tends to become blunted, leading to an irregular final result caused by the fact that fabric treated with new abrasive has a different surface treatment than that treated in the later stages with already partly worn abrasive. The blunting of the abrasive also makes it necessary to stop the machine at frequent intervals and change the abrasive belt, resulting in down time and high production costs.

SUMMARY AND OBJECTS OF THE PRESENT INVENTION

The subject of the invention is a machine of the type initially indicated that overcomes these drawbacks and that processes the fabric better.

Basically, the invention provides a machine in which the abrasive means consists of one or more blocks of abrasive material of cellular or honeycombed structure, and in which the relative velocity of the active surface of the abrasive means with respect to the fabric is of the order of 10 to 60 m/min, that is to say much less than the velocity commonly adopted in conventional machines using a different abrasive, especially one based on silica or corundum or similar materials.

The combination of the low relative velocity between the fabric and the abrasive and the use of an abrasive of cellular structure gives excellent results as regards the quality of the treated fabric. In addition, the cellular structure of the abrasive mass means that treatment can proceed uninterruptedly without the need for replacing or dressing the abrasive, since the continual superficial wear of the cellular abrasive material continuously brings new cells or honeycomb holes to the surface. The wearing action is provided by the edges of the cells or honeycomb holes; the wearing of the material produces not blunting, but continuous exposure of new cells, with a continual and automatic generation of new abrasive edges.

The resulting powder of abrasive material which collects in the fabric can be easily removed in subsequent treatments of washing or of free drying, so that the fabric is absolutely free of impurities when it comes to be used for making the garment.

Advantageously, the abrasive means may consist of pumice stone or a conglomerate of pumice stone with a suitable binder, for example a blown cement. The abrasive means may consist of an oscillating bar or of a cylinder which rotates or oscillates about a transverse axis with respect to the fabric forwarding motion. In both cases the abrasive means may consist of a plurality of blocks of small dimensions. In particular, in the case of a cylinder, this may consist of "slices" of abrasive material, such as pumice or the like. The slices may be bounded not only by the cylindrical surface but by two parallel planes. These planes advantageously may be inclined to the axis of rotation. This avoids the leaving of a mark of the line of separation between one element and the next on the treated fabric.

In order that the fabric be processed well, it must be treated wet. The machine can therefore be equipped with means for spraying a liquid onto the fabric before or during the abrasive treatment. This liquid may be water or, more preferably, water and a surfactant.

Further advantageous features of the machine of the invention are indicated in the accompanying claims.

In particular, the machine may be provided with reversible feeding means, by which the fabric may be fed through in both directions. In this way the processing may be performed with successive cycles of treatment of the same fabric, which is initially unwound from a first reel, treated by the abrasive means, and rewound onto a second reel, after which it is unwound from the second reel to be treated again and rewound onto the first reel. The cycle may be repeated any number of times according to the processing requirements of the specific fabric.

The invention also relates to a method for the superficial abrasive treatment of fabrics, in which a fabric in strip form is fed continuously to an abrasive means and pressed against it in order to undergo the abrasive action of the abrasive means. According to the invention, the method is distinguished by the fact that the fabric is made damp before or during the abrasive treatment, the abrasive means is of cellular or honey-combed structure, and the relative velocity between the surface of the abrasive means acting on the fabric and the fabric itself is between 10 and 60 m/min.

According to the invention there is advantageously applied to the fabric a surfactant, consisting for example of a soap, such as a sulfonate to which specific softeners have been added. The surfactant facilitates processing by the abrasive material. In addition, it has the effect of avoiding the impregnation of impurities into the open cavities or cells of the abrasive material, preventing their becoming clogged up and a consequent reduction in the abrasive effect. Also, during processing the surfactant helps to separate from the fibers the chemical substances that come off the fabric.

In an improved embodiment of the method of the invention, there is applied to the fabric, in addition the surfactant, a thickening solution. This solution may be based on agar-agar or on equivalent synthetic thickeners well known to those skilled in the art. The thickening solution may be distributed over the fabric my means of a doctor blade or equivalent provided on the machine. The thickening solution gives the surfactant a gelatinous consistency and saves having to apply an excessive amount of water to the fabric, since the solution with thickener distributes itself mostly on the surface to be treated and remains localized there. This limits the amount of water needed for the treatment and therefore makes the treatment itself more economical and less contaminating.

Silica powder advantageously may be applied to the fabric, for example in suspension in the thickening solution. This silica powder exerts an additional abrasive action as it is rubbed over the fabric by the cellular abrasive means. However, in contrast to conventional methods, in which the silica is supported by an abrasive belt, the silica in suspension is not subject to blunting since it is continuously replaced.

Further advantageous embodiments of the invention are indicated in the accompanying claims.

The invention will be made clearer by the description and the accompanying drawing, which latter shows a practical and non-restrictive embodiment of the invention.

DETAILED DESCRIPTION OF THE PREFERRED EMBODIMENTS

Figure 1:
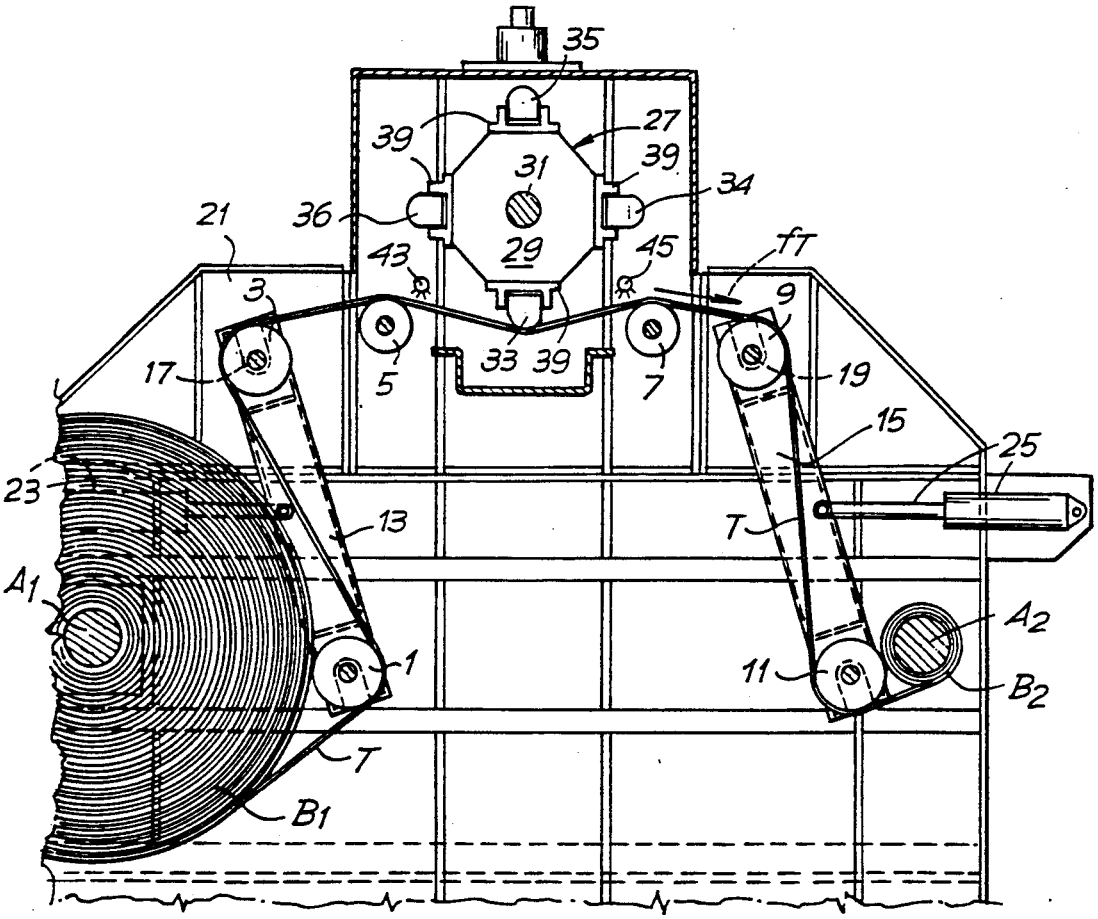
FIG. 1 shows a diagrammatic front elevation of a machine according to the invention.

With initial reference to FIG. 1, A1 and A2 indicate the supporting spindles of two reels B1 and B2 of a fabric T in strip form which is to undergo a superficial roughening or abrading treatment. As represented in FIG. 1, the reel B1 is full and the fabric T is unwound from it, treated and rewound after the treatment onto the reel B2. As will be explained later, the treatment may be repeated any number of times by reversing the movement of the fabric and hence unwinding it from the reel B2 and rewinding it onto the reel B1. The fabric is guided around six guide rollers indicated by 1, 3, 5, 7, 9 and 11 respectively. The rollers 1 and 11 are supported by corresponding arms 13 and 15 pivoting at 17 and 19 on the structure 21 of the machine. The arms 13 and 15 are stressed against their respective reels B1 and B2 by means of actuator cylinders 23, 25 which maintain the rollers 1 and 11 in continuous contact with the surfaces of the reels B1 and B2.

In the embodiment shown in FIG. 1, between the rollers 5 and 7 is an abrasive unit indicated as a whole by 27. The abrasive unit 27 comprises a moving element 29 which oscillates about an axis 31. On the moving element 29 are one or two or three or more abrasive bars, such as 33, 34, 35, 36 which may be used alternately. As shown in FIG. 1 the abrasive bar 33 is in the active position, while the others are in positions of non-use. Each bar is removably attached to the moving element 29 by means of locking brackets 39. Each abrasive bar 33, 34, 35, 36 is composed of a material of cellular or honeycombed structure, that is of a material composed throughout of a multiplicity of cavities or cells bounded by thin walls. A material with these features is pumice stone, and the abrasive bars, 33, 34, 35, 36 may therefore be formed from one or more blocks of suitably shaped pumice stone. Alternatively, a conglomerate of little lumps of pumice stone bound with a suitable binder, for example a blown cement, may be used. During the abrasive action, the surface of the abrasive bar in action is continually worn away by friction, so that new cells continually come to the surface, their thin walls forming an abrasive means which is not subject to blunting by being worn away.

While the fabric T is forwarded in the direction indicated by the arrow fT (or in the opposite direction) by the rotation of the supports of the reels B1 and B2, the fabric is subjected to the abrasive action of the bar 33 Which oscillates. The rollers 5 and 7 and the moving element 29 are arranged in such a way as to guarantee sufficient force of pressure of the fabric on the active surface of the abrasive bar 33. The wearing away of the abrasive bar, and the adjustment of the pressure, are obtained by means of a movement in the vertical direction of the moving element 29 in the manner described below. In addition, in order to obtain uniform wear of the abrasive bar 33, the latter advantageously is given a transverse oscillating movement, that is perpendicular to the plane of FIG. 1.

The fabric forwarding velocity is typically between 10 and 60 m/min. The oscillation of the moving element 29 may vary between 0° and 30°, with a speed of 0 to 30 oscillations per minute.

The fabric T is made damp before being subjected to the abrasive action of the bar 33. For this purpose, nozzles 43 and 45 are provided on both sides of the moving element 29. These nozzles are used alternately, depending on the fabric forwarding direction, in order to distribute water or water with a suitable surfactant, such as a sulfonated soap to which a specific softener can be added. Through other distributing means, a predetermined amount of silica in suspension may also be applied to the fabric surface.

Figure 2:
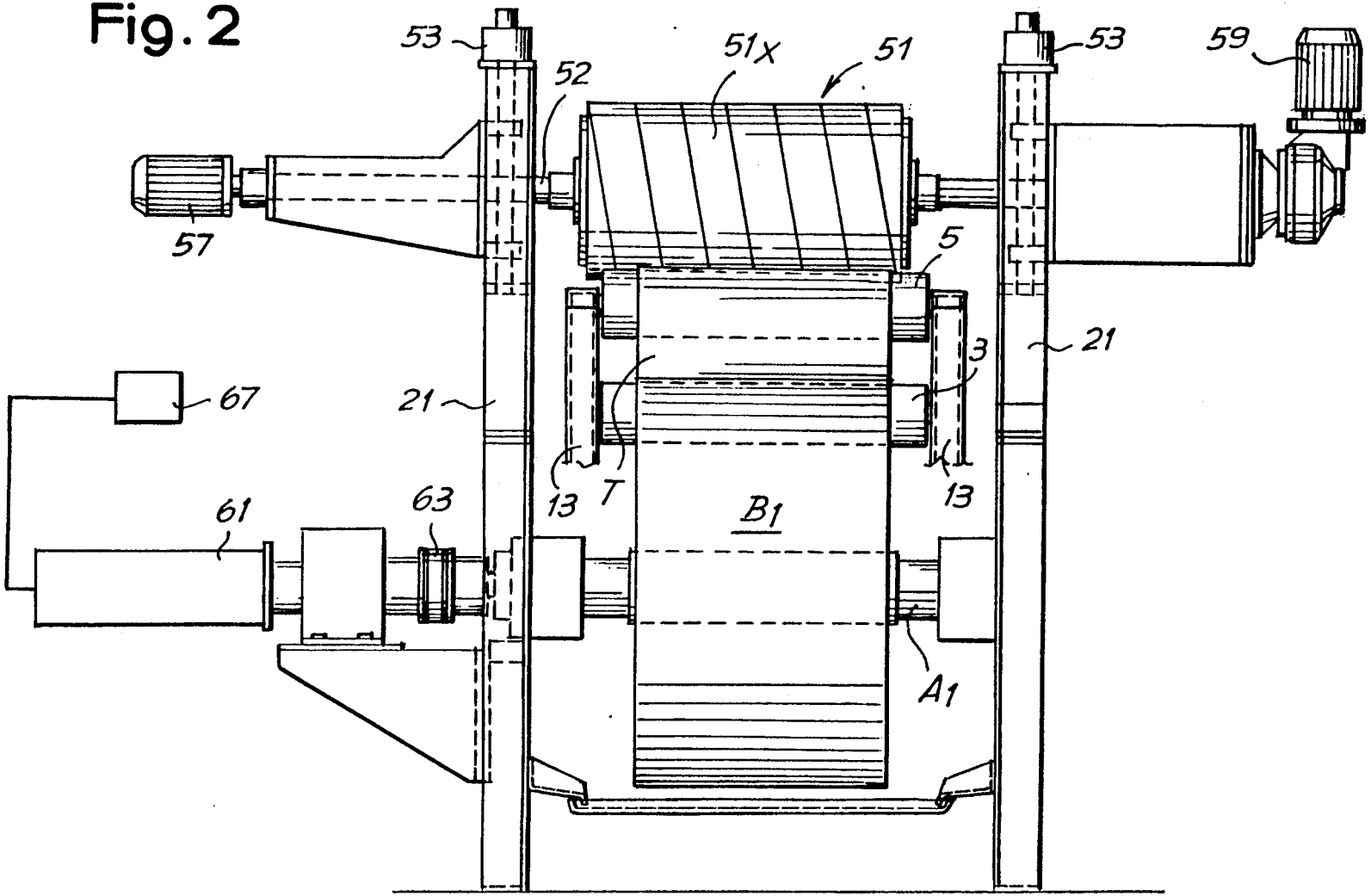
FIG. 2 shows a diagrammatic side elevation of a machine in a slightly modified embodiment.

FIG. 2 shows a side elevation of the machine in FIG. 1 but with a slight modification, ha/holy that in this embodiment the moving element 29 of the abrasive 15 unit 27 is replaced with a rotating cylinder 51 (which can rotate at from 1 to 50 revolutions per minute). Identical numerals indicate parts corresponding to the embodiment in FIG. 1. The actuating means for feeding the fabric through and for powering the abrasive unit are the same as may be used in the embodiment in FIG. 1. The cylinder 51 is supported by a shaft 52 which can be moved vertically by a pair of actuators 53 arranged in the upper part of the structure 21 of the machine. The actuators 53 are used, therefore, to adjust the height of the active surface of the abrasive unit and hence both compensate for wear of the abrasive material during the processing, and also serve to establish the pressure with which the abrasive unit (cylinder 51 or bar 33) acts on the fabric.

The translational movement in the transverse direction with respect to the movement of the fabric is provided by an actuator 57, while the rotational movement of the cylinder 51, or of oscillation of the moving element 29 and hence of the abrasive bar 33, is provided by a motor 59 arranged on the opposite side of the machine. The actuators 57 and 59 follow the vertical movement of the cylinder 51 or moving element 29, produced by the actuators 53.

The same motor 59 may be used for powering either the oscillating moving element 29 or the rotating cylinder 51. In fact it is sufficient for this purpose provide, in the case of the use of the oscillating moving element 29, two limit switches which limit the amplitude of the oscillation of the moving element by continually reversing the direction of rotation of the motor 59. When a cylinder 51 is used instead of the oscillating moving element 29, the limit switches are deactivated.

The rotational movement of the reel B1 when unwinding the fabric T is provided by a d.c. motor 61 which transmits the motion to the spindle A1 via a flexible coupling 63. A number of encoders connected to units in contact with the fabric and caused to operate alternately—according to the direction of motion—are used, together with a central processing unit diagrammatically indicated by 67, to maintain a constant feed velocity of the fabric T.

As visible in FIG. 2, the cylinder 51 is made with a plurality of blocks or "slices" 51X of a material of cellular or honeycombed structure. Each block is bounded by a cylindrical surface which forms part of the active surface of the cylinder 51, and by two parallel planes that are inclined with respect to the axis of the cylinder.

Figure 3:
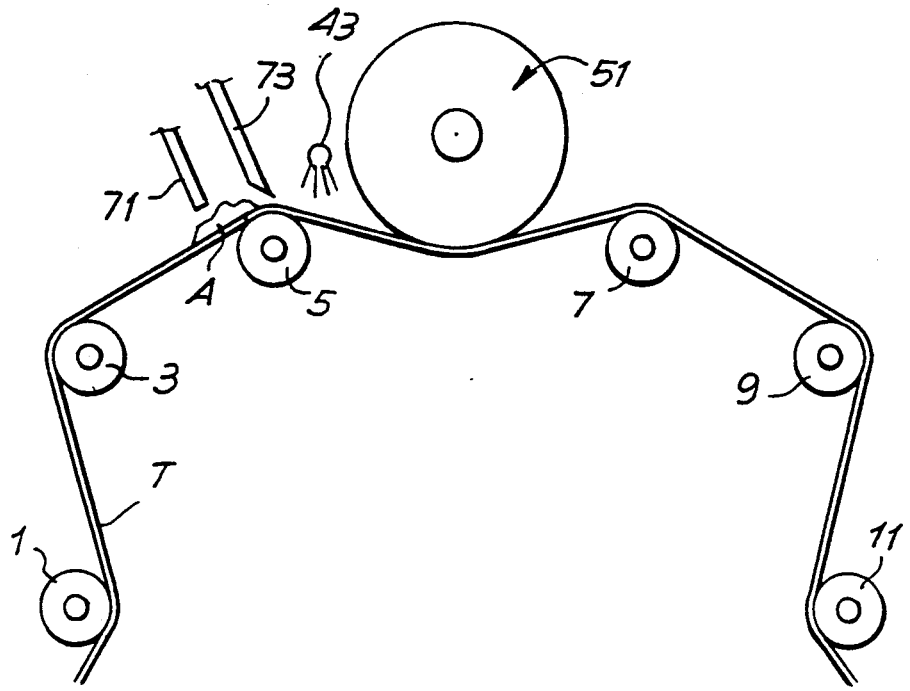
FIGS. 3 and 4 show two diagrams of other embodiments of the machine according to the invention.

FIG. 3 shows in a highly diagrammatic form an embodiment in which, upstream of the abrasive unit, there is a distributor 71 with a doctor blade 73 for distributing over the surface of the fabric to be treated a thickening solution A. This solution, based on agar-agar, on synthetic thickeners or the like, prevents the liquid applied later to the fabric by the nozzles 43 from passing through the full thickness of the fabric, thereby limiting the water consumption. In addition, where the liquid distributed contains a surfactant, the thickening solution gives a gelatinous consistency to said surfactant, permitting superior processing.

In FIG. 3 the abrasive unit is formed by the cylinder 51, but the doctor blade distributor 71, 73 may of course also be used in a machine with an oscillating moving element 29.

Figure 4:
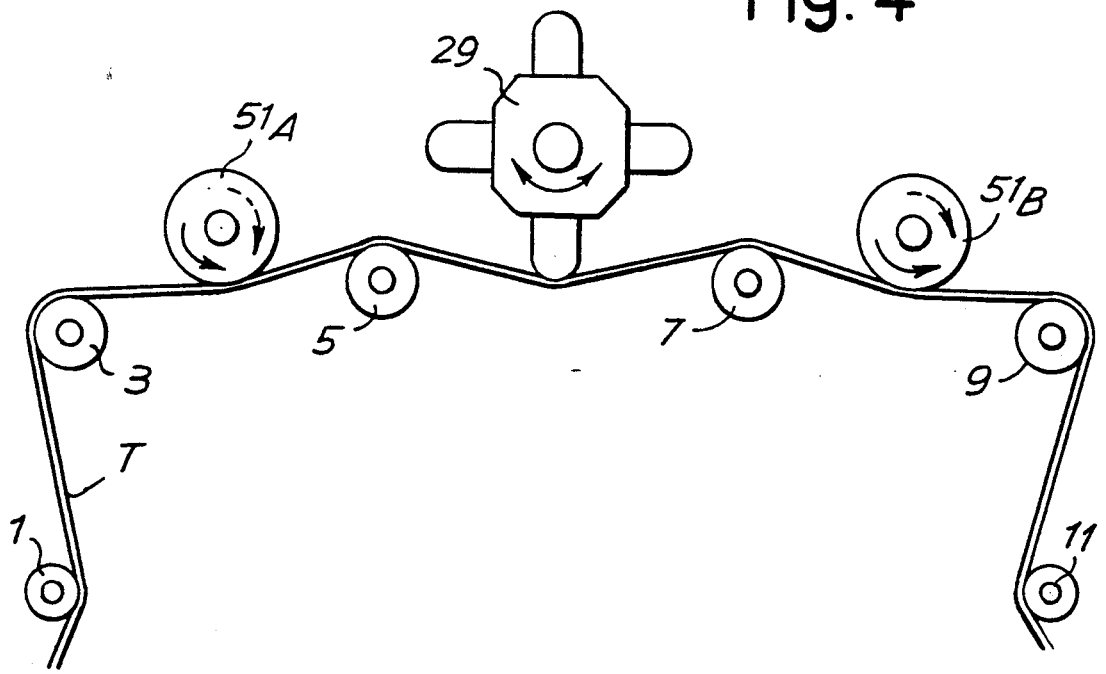

FIG. 4 shows, in a highly diagrammatic manner, a version in which three abrasive units are provided, in particular two cylinders 51A, 51B and an oscillating moving element 29. The arrangement may also be the reverse, with one abrasive cylinder in a central position and two oscillating moving elements upstream and downstream of the cylinder.

Figure 5:
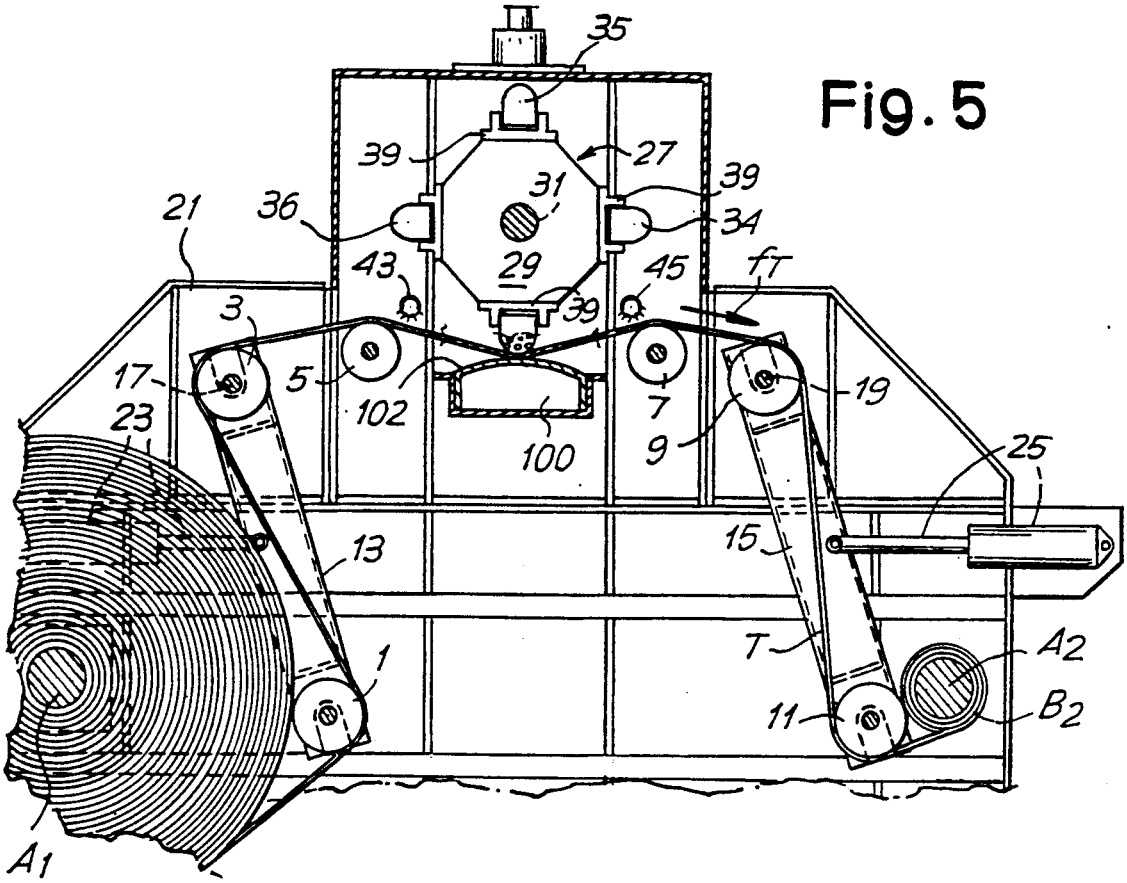
FIGS. 5 and 6 show front elevations of the machine in two modified embodiments.

FIG. 5 shows a front elevation similar to FIG. 1 of a slightly modified embodiment of the machine according to the invention. Identical numerals indicate parts corresponding to the embodiment in FIG. 1. In this embodiment, underneath the working zone of the abrasive bar 33 (34, 35 or 36) there is an inflatable controlled-pressure elastic lung unit 100. This lung generates a pressure pushing the fabric T against the abrasive, which pressure can be varied by acting on the internal pressure of the lung 100. Over the lung 100 is a sheet 102 made of steel, "Teflon" or other elastic material with a low coefficient of friction. As the fabric T is processed, it runs over the sheet 102 and is pressed against the abrasive.

Figure 6:
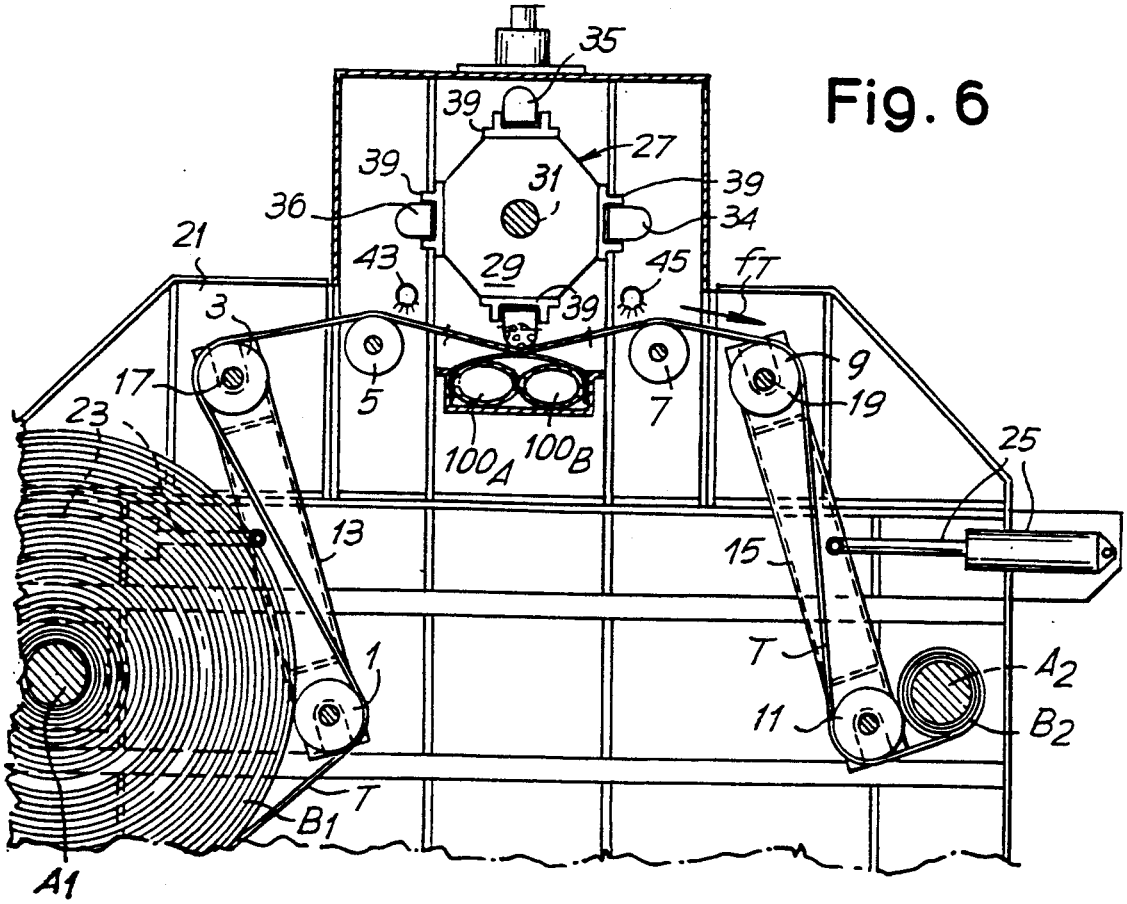

FIG. 6 shows an embodiment similar to that of FIG. 5, in which the single lung 100 is replaced by a pair of lungs of smaller size indicated by 100A and 100B. Once again a sheet 102 is provided to facilitate the sliding of the fabric and avoid wear to the lungs. It is also possible to use a different number of lungs, for example three or more. Whichever the case, the lung or lungs extend preferably across the full width of the machine.

The use of more than one lung that can be inflated independently and to different pressures, allows greater processing precision. The use of the lung or lungs may be combined also with the embodiment in which a rotating cylinder 51 is used.

The drawing shows only an illustrative embodiment of the invention, which may vary as regards shapes and arrangements. Any reference numerals appearing in the accompanying claims are for the purpose of facilitating the reading of the claims with reference to the description and to the drawing.

We claim:

1. A method for an abrasive treatment of a fabric, the method comprising the steps of:

providing an abrasive unit containing an abrasive material with a plurality of cavities bounded by walls, a surface of said abrasive material being substantially uniform across a width of the fabric;

moving the fabric at a substantially uniform speed past said abrasive unit;

pressing the moving fabric against sad abrasive material to cause the pressed fabric to undergo abrasive action from said abrasive material and to continuously remove exposed portions of said walls of said abrasive material while simultaneously exposing new portions of said walls of said abrasive material;

dampening the fabric during one of before and during said pressing of the moving fabric against said abrasive material;

oscillatingly moving said abrasive material transversely across the width of the fabric to substantially uniformly remove said exposed portions of said walls of said abrasive material while substantially uniformly exposing said new portions of said walls of said abrasive material.

2. A method in accordance with claim 1, wherein:

said walls of said abrasive material are of a thickness to cut and abrade portions of the fabric.

3. A method in accordance with claim 1, wherein:

said abrasive material is formed into a plurality of slices and mounted on a shaft extending across the width of the fabric, said plurality of slices forming a substantially cylindrical outer surface, and said plurality of slices having adjacent sides angularly spaced form a direction of said moving of the fabric; and rotation said plurality of slices about an axis of said shaft in a direction substantially opposite to said direction of said moving of the fabric.

4. A method in accordance with claim 1, further comprising:

wrapping the fabric around said abrasive material only a by a few degrees during said pressing of the moving fabric against said abrasive material.

5. A method in accordance with claim 1, wherein:

a relative velocity between the fabric and said abrasive means is between ten (10) and sixty (60) meters per second.

6. A method in accordance with claim 1, further comprising:

distributing a surfactant on the fabric prior to said abrasive action.

7. A method in accordance with claim 6, wherein:

said surfactant is sulfonate with a softener.

8. A method in accordance with claim 7, wherein:

said softener is lanolin.

9. A method in accordance with claim 6, further comprising:

applying a solution with a thickener to the fabric.

10. A method in accordance with claim 1, wherein:

a direction of said moving of the fabric is reversed after a portion of the fabric has past said abrasive material in order to for the fabric pass by said abrasive material twice.

11. A method in accordance with claim 1, further comprising:

distributing silica suspended in a liquid on the fabric prior to said abrasive action.

12. A method in accordance with claim 1, further comprising:

providing a pressure means for pressing the moving fabric against said abrasive material, said pressure means being positioned adjacent said abrasive material and the fabric moving between said pressure means and said abrasive material.

13. A method for an abrasive treatment of a fabric, the method comprising the steps of:

providing an abrasive unit containing an abrasive material with a plurality of cavities bounded by walls, a surface of said abrasive material being substantially uniform across a width of the fabric, said abrasive material formed into a plurality of bars extending across the with of the fabric, with only one of said bars being in contact with the fabric at one time, said bars being angularly space about a shaft extending across the width of the fabric;

moving the fabric at a substantially uniform speed past said abrasive unit;

pressing the moving fabric against said abrasive material to cause the pressed fabric to undergo abrasive action from said abrasive material and to continuously remove exposed portions of said walls of said abrasive material while simultaneously exposing new portions of said walls of said abrasive material;

dampening the fabric during one of before and during said pressing of the moving fabric against said abrasive material;

oscillating said bars about said shaft in a direction substantially parallel to a direction of said moving of said fabric, said oscillating having an amplitude between zero (0) and thirty (30) degrees, and a frequency between zero (0) and thirty (30) Hertz.

* * * * *